US008322047B2

(12) United States Patent
Soltysiak et al.

(10) Patent No.: US 8,322,047 B2
(45) Date of Patent: Dec. 4, 2012

(54) SYSTEM AND METHOD FOR DRYING A FRESHLY PRINTED MEDIUM

(75) Inventors: John R. Soltysiak, Blasdeel, NY (US); Henderikus A. Haan, North Tonawanda, NY (US); Theodore F. Cyman, Jr., Grand Island, NY (US); Anthony V. Moscato, North Tonawanda, NY (US)

(73) Assignee: Moore Wallace North America, Inc., Chicago, IL (US)

( * ) Notice: Subject to any disclaimer, the term of this patent is extended or adjusted under 35 U.S.C. 154(b) by 442 days.

(21) Appl. No.: 12/215,465

(22) Filed: Jun. 27, 2008

(65) Prior Publication Data

US 2009/0013553 A1 Jan. 15, 2009

Related U.S. Application Data

(60) Provisional application No. 60/937,675, filed on Jun. 29, 2007.

(51) Int. Cl.

| | |
|---|---|
| ***F26B 3/04*** | (2006.01) |
| ***F26B 13/04*** | (2006.01) |
| ***F26B 25/00*** | (2006.01) |

(52) U.S. Cl. ..... 34/620; 34/624; 34/629; 34/218

(58) Field of Classification Search ..... 34/620, 34/623, 624, 629, 218

See application file for complete search history.

(56) References Cited

U.S. PATENT DOCUMENTS

| | | | | |
|---|---|---|---|---|
| 1,463,923 | A | | 8/1923 | Nelson |
| 2,639,364 | A | * | 5/1953 | Doyle ..... 219/201 |
| 3,303,628 | A | * | 2/1967 | Lovas et al. ..... 53/433 |
| 4,619,050 | A | * | 10/1986 | Klemm ..... 34/278 |
| 4,622,761 | A | | 11/1986 | Barth |
| 4,719,708 | A | | 1/1988 | Karlsson et al. |
| 4,753,216 | A | * | 6/1988 | Nolte ..... 126/41 C |
| 4,756,091 | A | * | 7/1988 | Van Denend ..... 34/266 |
| 4,833,794 | A | | 5/1989 | Stibbe et al. |
| 4,949,478 | A | | 8/1990 | Socha |
| 5,296,873 | A | | 3/1994 | Russell et al. |
| 5,396,716 | A | | 3/1995 | Smart et al. |
| 5,502,788 | A | | 3/1996 | Platsch |
| 5,579,590 | A | | 12/1996 | Seidl et al. |
| 5,966,836 | A | | 10/1999 | Valdez, III et al. |
| 6,308,626 | B1 | | 10/2001 | Crystal et al. |
| 6,505,419 | B2 | | 1/2003 | Poetter |

(Continued)

FOREIGN PATENT DOCUMENTS

GB 667412 2/1952

OTHER PUBLICATIONS

International Search Report and Written Opinion in PCT/US2008/008113 dated Nov. 27, 2008.

(Continued)

*Primary Examiner* — Jiping Lu

(74) *Attorney, Agent, or Firm* — McCracken & Frank LLC

(57) ABSTRACT

A drying unit includes a frame having an air box mounted thereon, wherein the air box includes an intake port and an exhaust port. A plurality of rollers define a web path within the frame and a heat source is removably attached to the frame, wherein removal of the heat source does not require removal of a web from the web path.

6 Claims, 13 Drawing Sheets

U.S. PATENT DOCUMENTS

| | | | | |
|---|---|---|---|---|
| 6,591,518 | B2 | 7/2003 | Barberi | |
| 6,601,318 | B1 | 8/2003 | Platsch | |
| 6,644,192 | B2 | 11/2003 | Dilling et al. | |
| 6,647,640 | B2 * | 11/2003 | Greive | 34/275 |
| 6,647,881 | B2 | 11/2003 | Mueller et al. | |
| 6,722,393 | B1 * | 4/2004 | Marett et al. | 139/291 R |
| 6,732,651 | B2 | 5/2004 | Dziedzic et al. | |
| 6,739,246 | B2 | 5/2004 | Lan | |
| 6,805,049 | B2 | 10/2004 | Silverbrook | |
| 6,877,852 | B2 | 4/2005 | Hay et al. | |
| 6,944,970 | B2 | 9/2005 | Silverbrook et al. | |
| 6,971,313 | B2 | 12/2005 | Silverbrook | |
| 7,024,995 | B2 | 4/2006 | Silverbrook | |
| 7,073,274 | B2 | 7/2006 | Yoshida | |
| 7,073,439 | B2 | 7/2006 | Takahashi et al. | |
| 7,225,739 | B2 | 6/2007 | Silverbrook et al. | |
| 2005/0156974 | A1 | 7/2005 | Silverbrook et al. | |

OTHER PUBLICATIONS

International Preliminary Report on Patentability dated Jan. 5, 2010, Application No. PCT/US2008/008113.

* cited by examiner

SYSTEM AND METHOD FOR DRYING A FRESHLY PRINTED MEDIUM

CROSS REFERENCE TO RELATED APPLICATIONS

This application claims the benefit of U.S. Provisional Application Ser. No. 60/937,675, filed Jun. 29, 2007, and incorporated herein by reference in its entirety.

BACKGROUND

1. Technical Field

The technology presented herein relates to the field of printing and, more specifically, to a system and method therefor that directs radiant energy and air flow in and out of a printing system.

2. Description of the Background Art

Application of ink on a print medium can be accomplished using a variety of instruments, both manual and automated. In all cases in a process of printing a print medium, it is important to dry the surface to which the ink is applied prior to allowing the print medium to be stacked or otherwise touched. Methods known in the printing arts include use of blown air, whether heated or not, with or without radiant energy.

With respect to automated printing technology, two common printing methods involve lithography, whether offset or direct, and ink jet printing. In either case, drying the freshly printed surface in real time is a key consideration in machine design for optimizing speed. Although pre-cut print medium can be used in a high speed printing press, generally one can achieve greater speed and other economies using a continuous web of print medium. Either way, a printing system can include an airflow that passes resistor-based heating elements, or an airflow coupled to microwave or infrared radiation directed at a freshly printed medium, or, simply, an airflow of sufficient capacity that moisture or other evolving gases associated with the ink will exit the medium path of a print press in a timely fashion. However, such drying systems as used in the printing art are incorporated into a printing system without consideration for servicing the components thereof in the absence of removal of the print medium.

Another challenge of drying systems included with a printing press relates to the heat flow itself. With the advent of high speed printing methodologies and machines, the impact of removal of the spent air after the act of drying the print medium has become increasingly important with rising energy costs. Simply put, if the source of the air that is employed in the drying system of a print press is the building in which the print press is housed, and the spent air is exhausted from the building, then one impact will be a net loss of heat in a cold-ambient outside environment, as in winter, or a net gain of heat in a heat-ambient outside environment, as in summer. On the other hand, using outside air in winter will also increase energy costs owing to the need to warm such air to increase its capacity to remove evolving matter from the print medium.

SUMMARY

According to one embodiment, a drying unit includes a frame having an air box mounted within the frame, wherein the air box includes an intake port and an exhaust port. A plurality of rollers define a web path within the frame and a heat source is removably attached to the frame, wherein removal of the heat source does not require removal of a web from the web path.

Another embodiment, a drying unit includes a frame having a plurality of rollers that define a web path within the frame. A heat source is removably attached to the frame and an insulating panel is disposed adjacent the heat source. An air box is disposed downstream of the insulating panel, wherein the air box includes an intake port and an exhaust port. The heat source can be removed from the frame while a continuous web is in the web path.

According to yet another embodiment, a method of drying a printed web includes the steps of providing a frame and mounting an air box within the frame, wherein the air box includes an intake port and an exhaust port. The method includes the further steps of providing a plurality of rollers that define a web path within the frame, installing a continuous web in the web path and providing a heat source that is removably attached to the frame. Furthermore, the method includes the steps of depositing a marking substance on the continuous web and passing the continuous web adjacent the heat source, wherein the heat source can be removed while the continuous web remains in the web path.

The various features and advantages of the embodiments disclosed herein will become more readily apparent from a consideration of the following description, to be read in conjunction with the accompanying drawings, in which like reference numerals represent like elements throughout.

DETAILED DESCRIPTION

Figure 1:
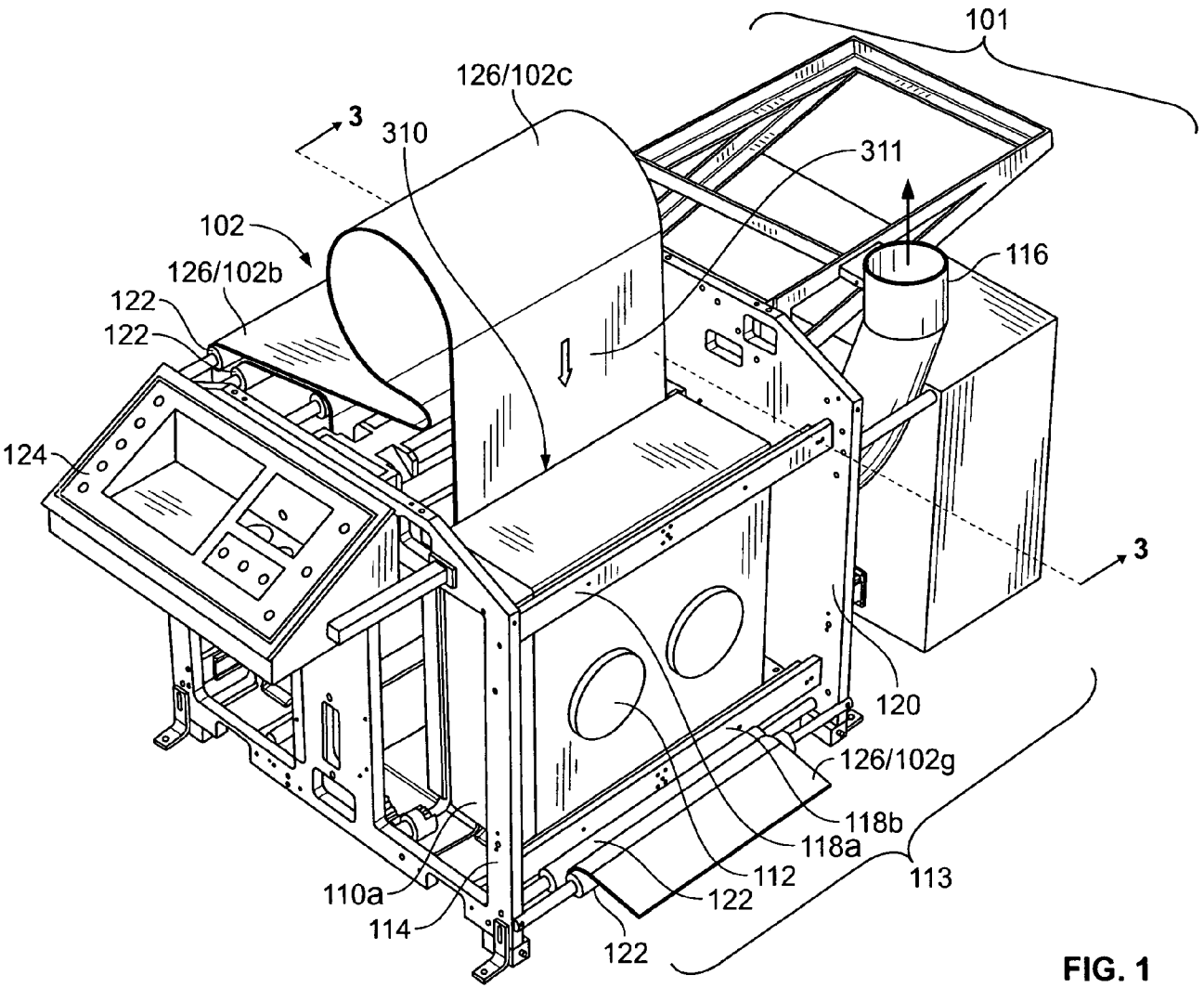
FIG. 1 is a top isometric view of a dryer system according to an embodiment of the present technology.

The present technology relates to a system for drying a freshly printed print medium. The print medium is any substantially flat material that is able to be transported along a path. Preferably, the print medium is paper or another printable medium comprising a web 126 formed into a roll. The web is unwound from the roll and follows a web path 102 in the printing system. As depicted in FIG. 1 and other figures, locations along the web path 102 are labeled with the numeral 102 followed by a lower case letter, as in 102*b* or 102*g*.

The web is printed, dried, and either rerolled or trimmed into sheets. Alternatively, the print medium may be initially formed into sheets and then printed, if desired. One embodiment entails a printing system for the printing of the paper web 126 used for the construction of books and for other printed matter. Another such embodiment entails a printing system for the printing of a print medium used for the construction of wall papers and draperies, for example. These examples should not be considered limitative in any way. What follows are descriptions of various aspects of a dryer system that can be attached to and/or used with an imaging unit of any design.

Figure 2B:
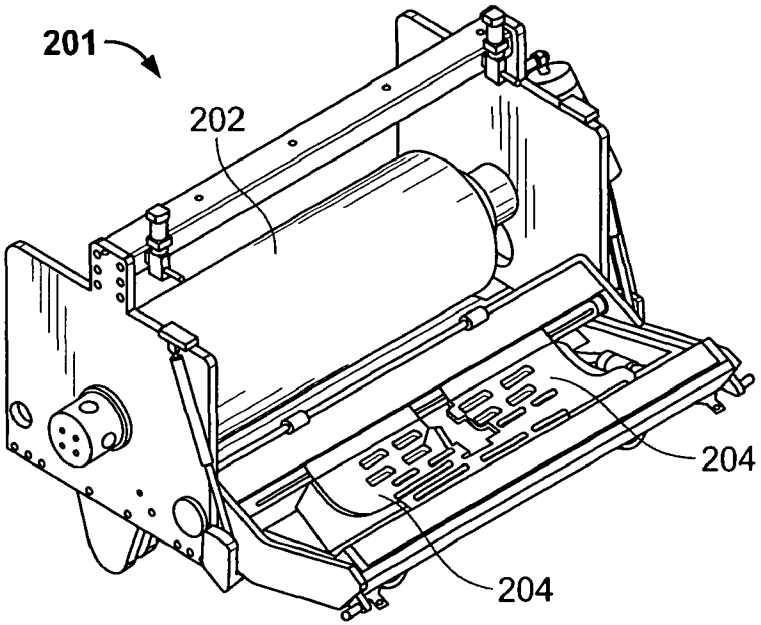
FIGS. 2A and 2B are isometric views of an imaging unit showing printhead assemblies in closed and open positions, respectively, which imaging unit can be used with the dryer system depicted in FIG. 1, for example.
Figure 2A:
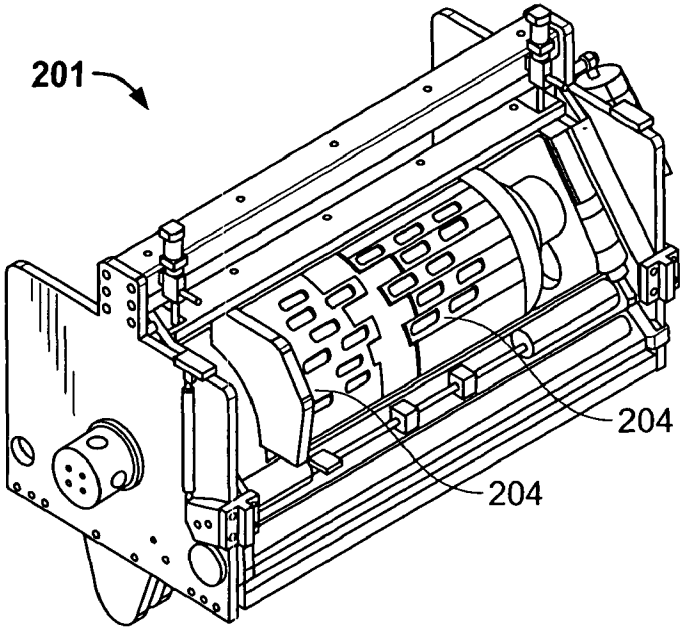
Figure 3:
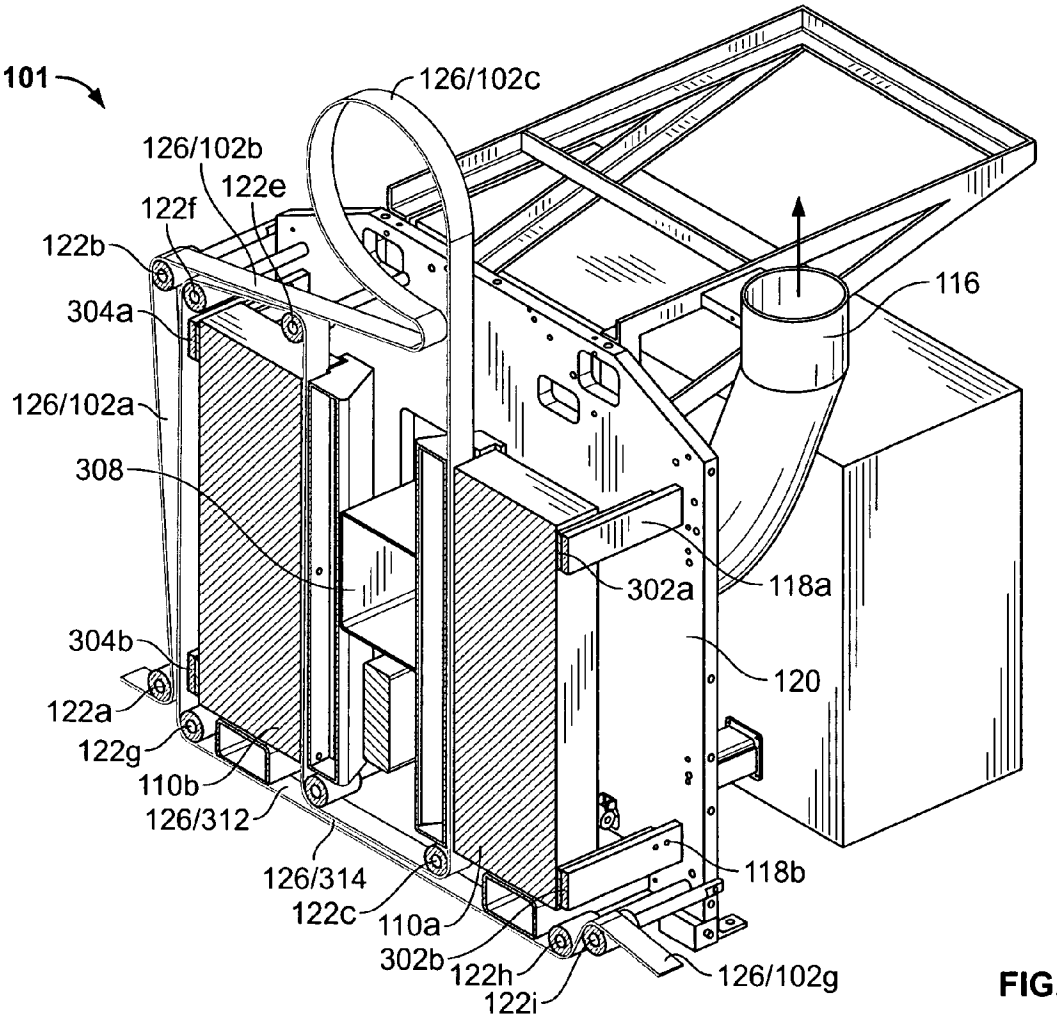
FIG. 3 is a cross-sectional trimetric view taken generally along the lines 3-3 of FIG. 1.

Referring now to the drawings, FIGS. 1 and 3 generally illustrate a dryer system 101 that is usefully employed with an exemplary imaging unit 201 (seen in FIGS. 2A and 2B) designed for printing the paper web 126. The imaging unit 201 includes four printhead assemblies 204 arranged about a rotatable drum 202. The web 126 at location 102*c* of FIGS. 1 and 3 is wrapped about the rotatable drum 202. Each printhead assembly 204 of the imaging unit of FIG. 3 includes inkjet printheads or cartridges similar or identical to that found in a desktop printer. Each printhead assembly 204 preferably prints one color on the paper web 126 as the paper web 126 traverses the web path 102 adjacent such printhead assembly 204 such that a first color of an image is printed first, a second color of the image is overprinted on the first color, and so on.

Each printhead assembly 204 has the ability to image laterally across the width of the web 126. Preferably, the image width produced by each printhead assembly 204 is up to 12 inches wide. Further, pairs of printhead assemblies 204 are axially positioned relative to one another so that the total print width spans up to the full width of the paper web 126 (typically 24 inches). In this way, the imaging unit 201 can print 2-up 8½×11 pages in either landscape or portrait fashion. Other page heights or widths could be produced in N-up fashion, if desired.

Servo-controlled cylinders (not shown) may be used to control the travel of the paper web 126 through the printing system. Paper tension is sensed using a transducer roll before the first imaging unit 201 and by transducers in each of the cylinders that comprise remaining imaging units 201. Programmable logic controllers in the printing system adjust the tension at the transducer roll and at each of the cylinders by adjusting the speed at which the roll and cylinders rotate. The web tension is adjusted at each print unit to compensate for changes in characteristics of the paper as it is printed upon. The surface of the cylinder is textured so that friction between the paper and the cylinder insures that the rotation of the cylinder can drive the paper without slippage. The positions of the printhead assemblies guarantee that the direction of travel of a drop of ink from each inkjet printhead is substantially perpendicular to the surface of the associated cylinder (and hence the paper).

The printing system in other embodiments includes a series of modular units that can be utilized as needed for the printing task to be undertaken. In other words, each imaging unit 201 may include only two printhead assemblies 204 (one on the left half of the unit and another on the right half of the unit) and the same or different inks may be fed to each printhead assembly 204 so that each assembly can print one side of a 12 inch page where each page is printed with the same or a different color. As noted above, each imaging unit 201 may further include two additional printhead assemblies 204. The additional assemblies 204 are positioned to overprint the color(s) deposited by the first two printhead assemblies 204. In this configuration, each imaging unit 201 is able to simultaneously print two simplex 12" pages in two different colors. Two such imaging units 201 operating in series can produce two simplex 12" four-color pages and four print units can produce two duplex 12" four-color pages. Also as noted above, depending upon the number of imaging units 201 that are used, one could alternatively produce 24 inch simplex or duplex pages in one to four colors.

After the web 126 is printed upon by an imaging unit 201, it must be dried prior to transference to a succeeding imaging unit 201 for further printing with respect to either side of the web 126. In the embodiment depicted in FIGS. 1 and 3, the imaging unit 201 just described can be installed on top of a base frame 113 formed by joining a front frame 114, a back frame 120, and cross members 118*a* and 118*b* on the right side and a second pair of analogously positioned cross members on the left side (not shown). The imaging unit 201 in this embodiment is supported by the base frame 113, such that the portion of the web 126 at a location 102*c* that is shown looped above the uppermost level of the base frame 113 is effectively wrapped about a drum (not shown) that is part of the imaging unit 201. The web 102 follows a path that is directed by various rollers 122*a* through 122*i*, such that the web 126 enters the imaging unit 201 from either a web container (not shown) or another imaging/drying combined unit (not shown) that is upstream of a position 102*a*. After receiving ink when wrapped upon the drum of the imaging unit 201, the web 126 enters a drying unit 101. In one embodiment, the drying unit 101 comprises two heat sources 110, two intake fans 112, an exhaust conduit 116, and a control panel 124. Whereas the drying unit 101 depicted in FIG. 1 includes two heat sources 110*a* and 110*b*, each of which includes two intake fans 112, it is the case that drying units taught in this specification may vary in content and capacity. Specifically, a drying unit as described herein may include a single heat source with a single corresponding fan, or may be more complex, including multiple heat sources and may include one, two, or more fans. As such, the drying unit 101 described herein is scalable up or down according to the drying needs of the particular print medium and printing ink(s) that are employed.

In the embodiment of FIG. 1, after printing, the web enters the drying unit 101 at the point 310 indicated by an arrow 311 (FIGS. 1 and 6) where it enters a first drying space, and thereafter, a second drying space (both described in greater detail hereinafter). The drying spaces are disposed between center portions of the heat sources 110 and an air box 308 (described in greater detail hereinafter in connection with FIG. 8), which is in fluid communication with the exhaust conduit 116. The exhaust conduit 116 described herein may be any single element or structure or combination of tubes, pipes, hoses, or any other conduit, flexible or rigid, capable of carrying a fluid, as is known in the art. An exhaust fan 312 (FIG. 5) is disposed in fluid communication with the exhaust conduit 116 and draws air away from the heat source(s). If desired multiple exhaust fans may be disposed in fluid communication with the exhaust conduit 116. The exhaust conduit 116 ultimately connects to a port (not shown) for exiting the spent air flow from the building that contains the printing/drying machine or, in the alternative, to a heat exchanger unit (not shown) and/or desiccating unit for capturing the heat or removing aqueous or organic volatiles contained in the air flow or both. Such heat that is captured from the air flow can be returned to the drying unit, added to heat requirements of the building as a whole, or otherwise used to reduce the energy needs of the printing/drying unit and the building as a whole.

The source of air that enters the drying system can be from the building generally, in which case the intake fans 112 can be employed without any further attachments at the point where air enters the fan portion 112 of the heat source units 110. Alternatively, the air used in the drying system can be filtered in order to remove any particulates that otherwise might foul the heat-producing portions of the heat sources or the printed print medium prior to drying.

In addition or yet another alternative, the air used in the drying system can be brought in from outside the building. In the instance of any of these alternative paths of the air introduced to the drying system, an intake conduit (not shown) is preferably connected to the air intake vents located at the outermost portion of the heat source 110*a* where the intake fan(s) 112 are located.

A control panel 124 is electrically connected to a controller (not shown) that controls operation of the heat source(s) 110, the rate of movement of the web 102, the intake fan(s) 112, and the exhaust fan 312. The controller may be an electronic device such as a computer or microprocessor that is responsive to a real-time clock, sensors that gauge degree of dryness of a surface, and other inputs and controls in accordance with the methods described herein.

Figure 4:
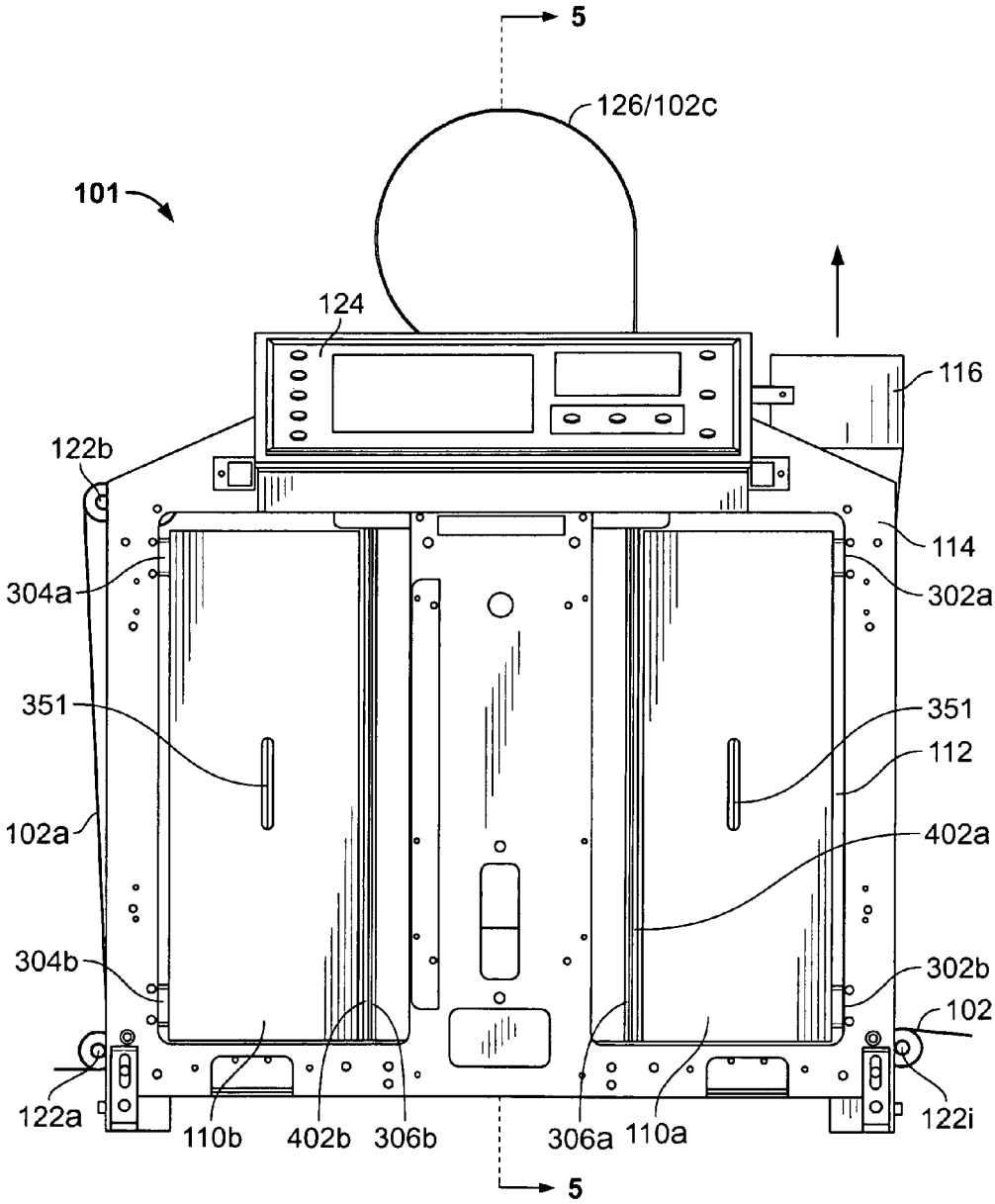
FIG. 4 is a front elevational view of the dryer system of FIG. 1.
Figure 7:
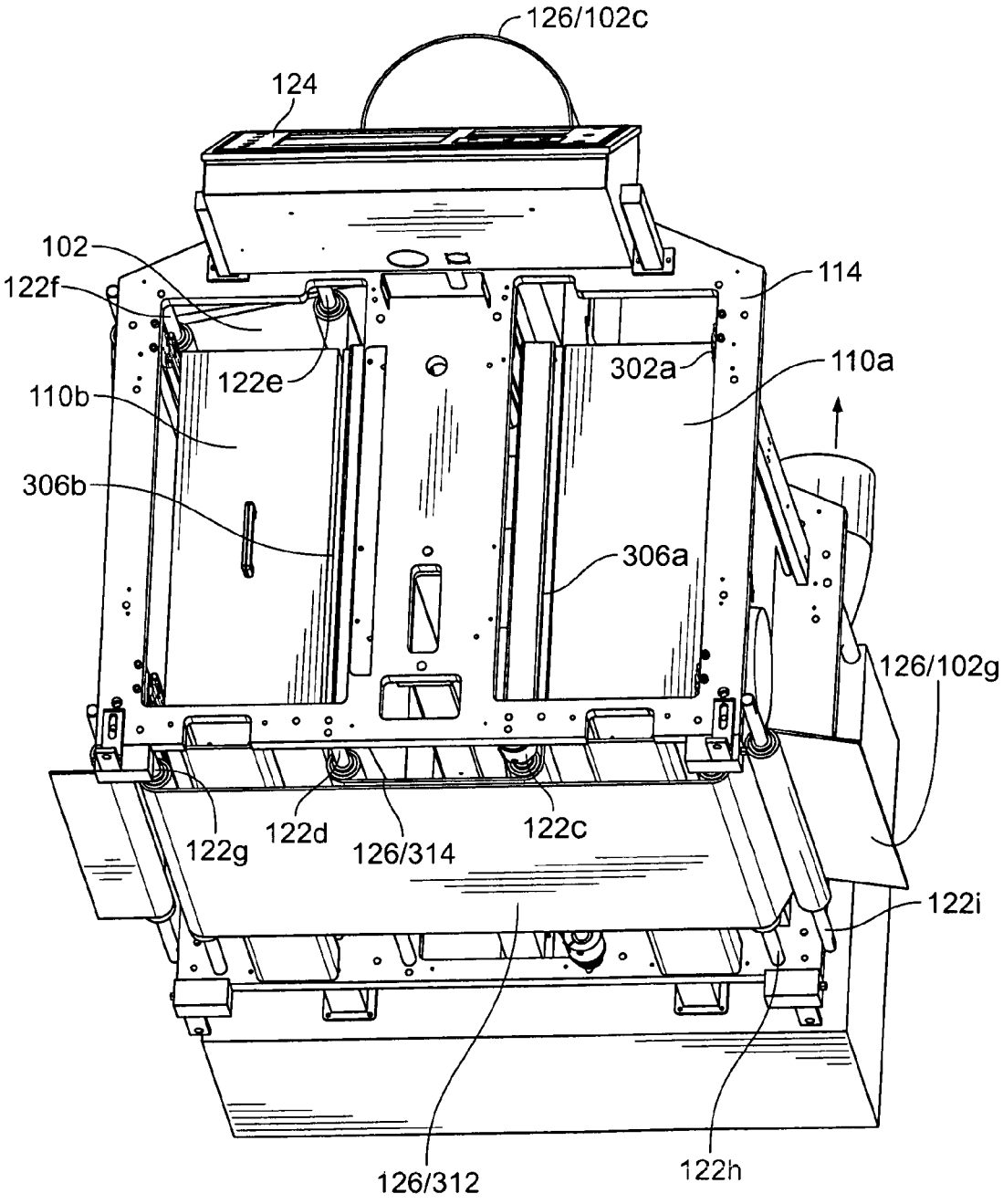
FIG. 7 is a trimetric view from the underside and front of the dryer system depicted in FIG. 1.
Figure 8:
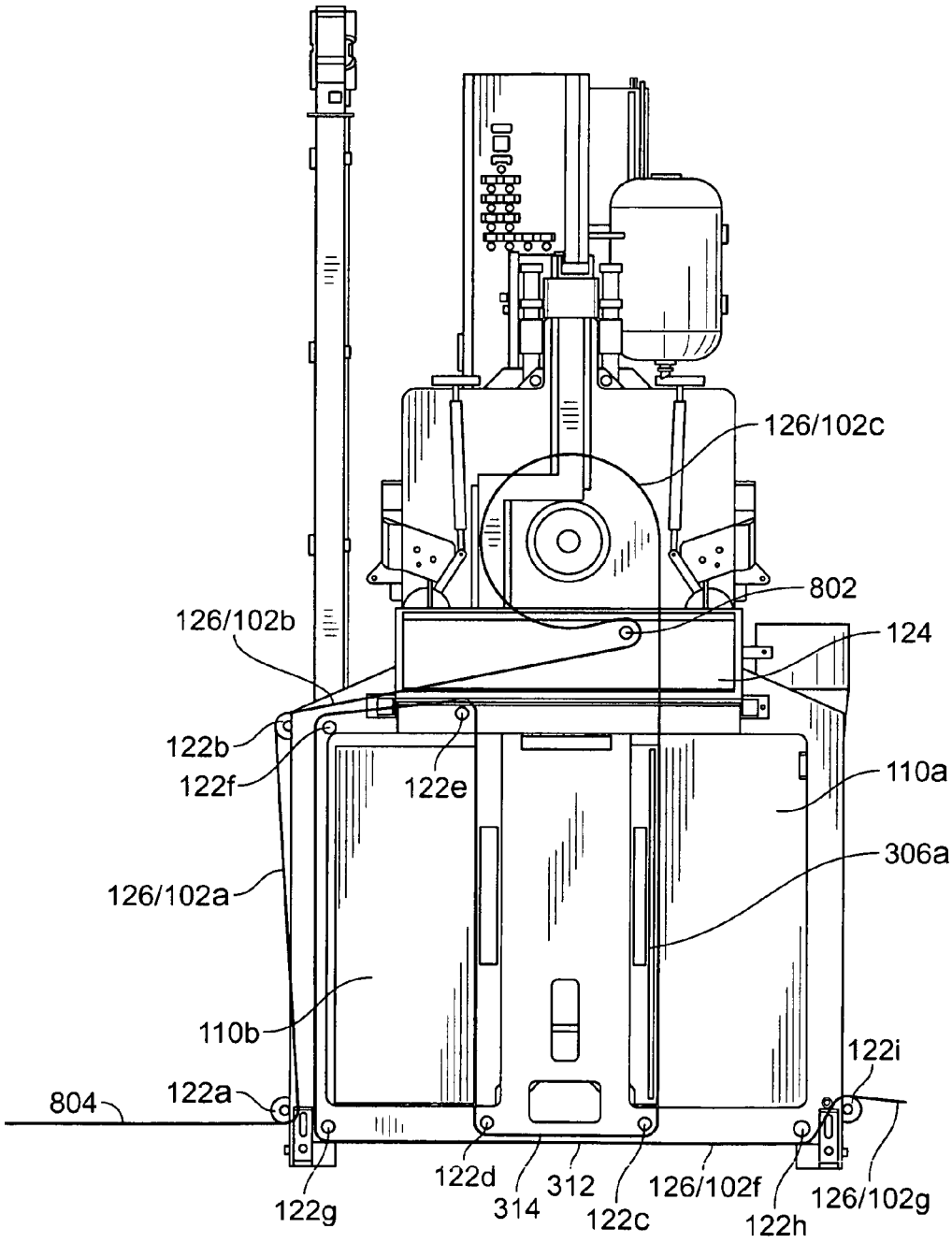
FIG. 8 is a schematic elevational illustration of the web path of the printing system depicted in FIG. 1.

More specifically as seen in FIGS. 3 and 8, incoming paper web 126 enters the imaging/dryer unit at roller 122*a*, which is on the left bottom as seen in FIG. 8. From there, the web 126 travels upwardly to roller 122*b*, then across the top of the drying unit 101 to the base of the drum (not shown) and contacts the drum at a roller 802. The web 126 at web path location 102*c* follows the contour of the drum heading up, around, then down into the entry point 310 into the dryer unit 101. Referring also to FIG. 4, the web 126 travels through the first drying space 402*a* between the central portion of the heat source 110*a* at a heat and air output end and an insulating panel 306*a* of an air box 308. The web 126 continues downwardly to roller 122*c* (also see FIG. 7) where it crosses under the air box 308 and heads upwardly at roller 122*d*. The upward web path takes the web through the second drying space 402*b* between a central portion of the second heat source 110*b* and a second insulating panel 206*b*. The web 126 then makes three approximately 90° turns at rollers 122*e*, 122*f*, and 122*g*, travels under the drying unit 101 and emerges therefrom at a slightly elevated level from the floor after passing around rollers 122*h* and 122*i*. At that point, the web 126 proceeds to the next imaging/dryer unit for further printing or to a machine designed for processing the printed print medium.

With respect to the air flow path, the fan(s) 112 included in the frame of the heat source 110 send air into the web path 102. The air then travels around the web and through apertures (described in greater detail hereinafter) in the insulating panels 306*a* and 306*b*. Air may also be exhausted through one or more optional apertures (not shown) extending through face surfaces of one or more of the insulating panels 306*a*, 306*b* of the air box 308. Air is not only directed into the air box by force of the intake fan(s) 112 in the heat source(s), but also by the force of the exhaust fan(s) 312 in fluid communication with the air box 308.

FIGS. 3 and 4 illustrate drawer-roller mechanisms 302*a*, 302*b* and 304*a*, 304*b* that slideably attach the respective heat sources 110 to the cross members 118*a*, 118*b* (the left side cross members are not visible in these FIGS.). Other mechanisms that promote sliding of a heat source relative to a frame can be substituted for the drawer-roller mechanisms, including, for example, rollers at the bottom of the frame, with or without tracks. The present disclosure comprehends the provision of one or more paths for the heat sources to move away from the base frame of the dryer unit without requiring removal or tearing of the web. In this manner, access to the heat sources 110 for servicing and repair thereof is facilitated without the downtime associated with re-webbing of the unit(s).

Figure 10:
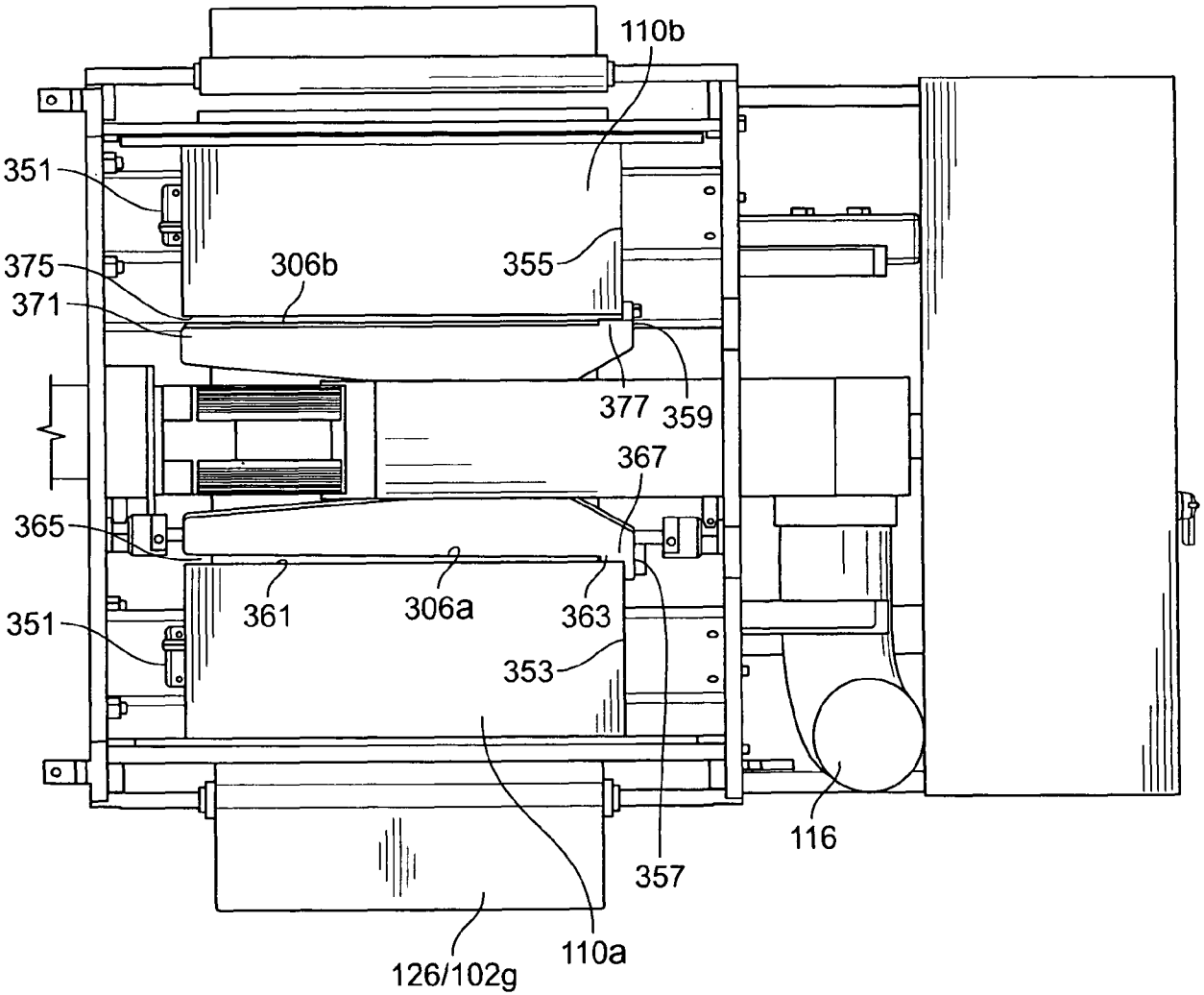
FIG. 10 a cross-sectional view of the dryer system of FIG. 1 from above.

Preferably, a roller or wheel mechanism as is known in the art is included with the heat sources 110 in order to more easily move same into and away from the web path. Handles 351 (FIGS. 4 and 10) may be provided to facilitate removal of the heat sources 110. In addition, as seen in FIG. 10, when the heat sources are fully installed into the base frame 113 of the dryer unit 110 first side portions 353 and 355 of the heat sources 110*a*, 110*b* engage flanges 357 and 359, respectively, that limit further movement of the heat sources 110 into the base frame 113. In addition, when in the fully installed position, opposing side surfaces 361 and 363 of the heat source 110*a* are urged into sealing contact with a first sealing wall 365 of the associated insulating panel 306*a* and a second sealing wall comprising an outturned flange 367. The heat source 110*b*, when fully installed, similarly is sealed at side edges thereof against the insulating panel 306*b* like the sealing of the heat source 110*a* against the insulating panel 306*a*. This side sealing minimizes escape of heat to the surroundings, except where the paper web 126 enters and exits the drying spaces 402*a* and 402*b*.

Each insulating panel 306*a* and 306*b* is preferably hollow, and includes at least one and preferably two or more side apertures, respectively, preferably disposed on either side of the web path 102. The apertures are similar or identical to apertures 908*a*, 908*b* shown in FIG. 9 and described in greater detail hereinafter. Each aperture is located inside the portions of the frame of the heat source 110 and the associated insulating panel 306*a*, 306*b* that undertake the side sealing function. The apertures permit fluid communication between the web path 102 and the exhaust conduit 116.

Figure 5:
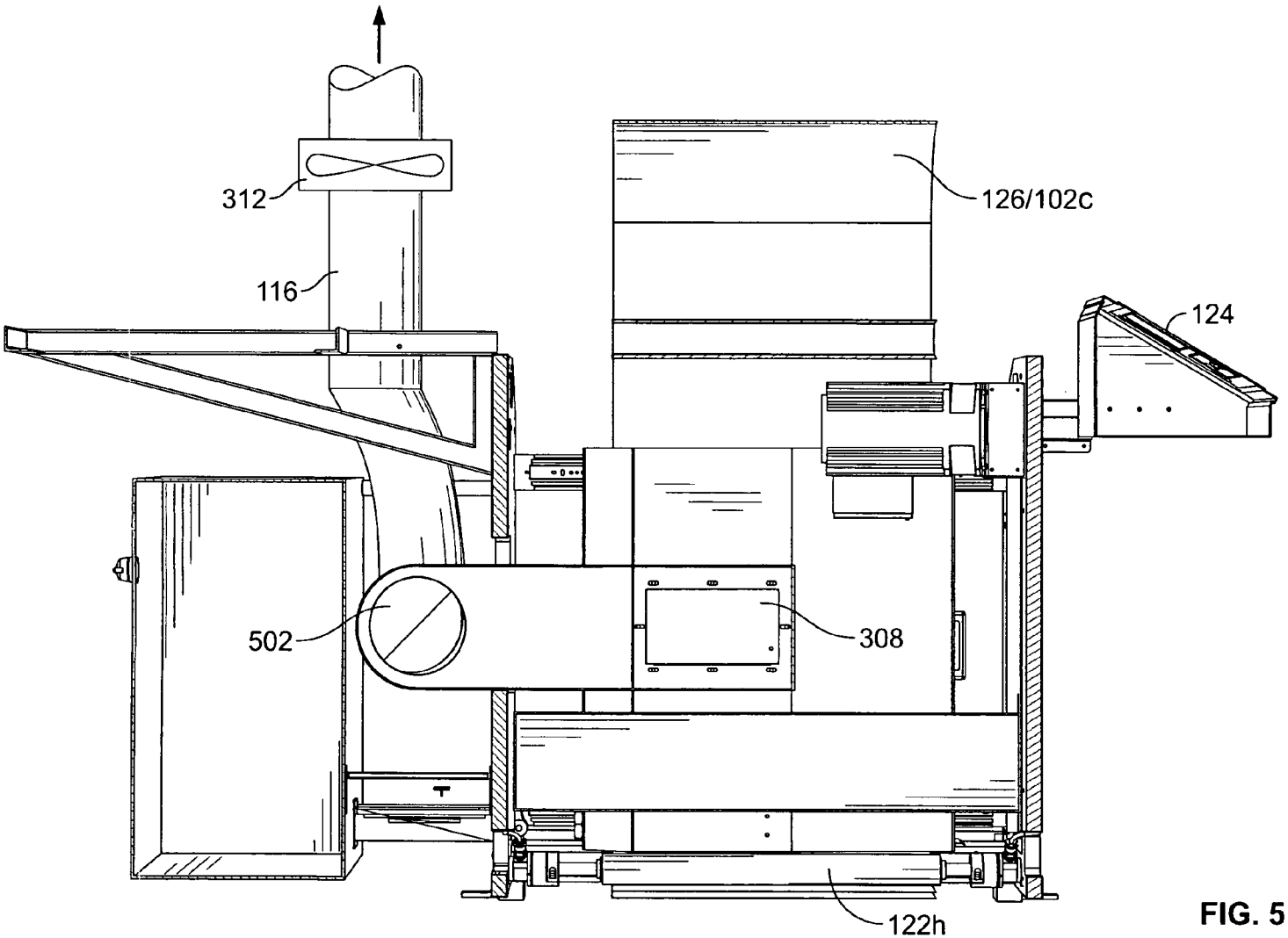
FIG. 5 is a schematic illustration of a longitudinal cross-sectional view taken generally along the lines 5-5 of FIG. 4.
Figure 6:
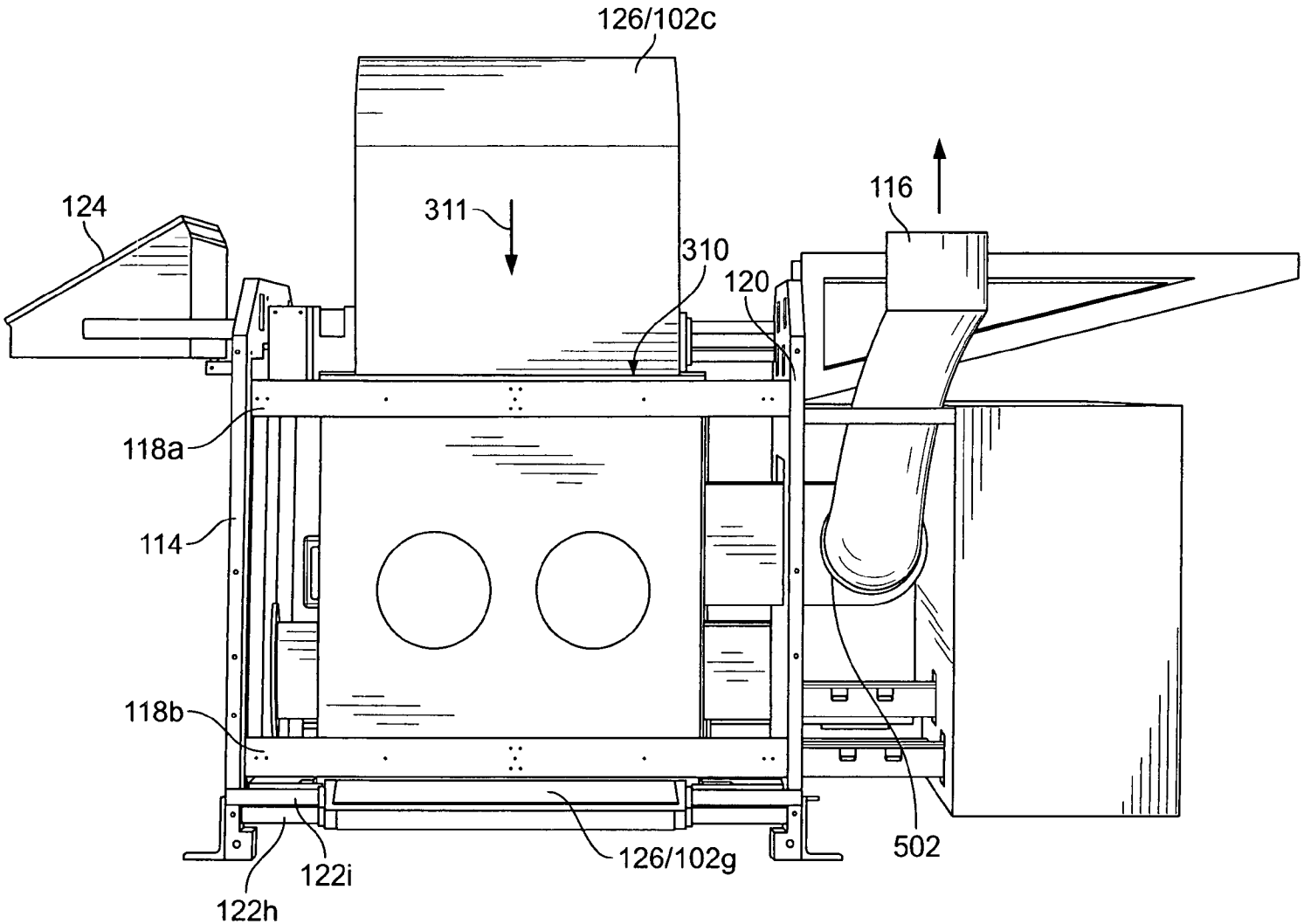
FIG. 6 is a side elevational view illustrating the right side of the dryer system depicted in FIG. 1.

As seen in FIGS. 5 and 6, fluid communication between the air box 308 and the exhaust conduit 116 is established at a junction 502. It is preferred that there be little constriction of the exhaust air path at and downstream of the junction 502.

In summary, and as noted above, the drying system may be modified for use with any printing system that involves placement of an ink onto a print medium, which ink and print medium combination is dryable using air plus heat. Further, the drying system includes a heat source that is preferably mounted in a frame. As noted above, the frame can be removed from the drying system for repair or servicing without requiring disruption or removal of the web that is in place in the web path of the printing system (which includes the drying system). The framed heat source can be slideably or rollably removed, where a ball-bearing based mechanism is attached and by which the framed heat source readily moved in or out of the drying system assembly. Particularly if a ball-bearing based mechanism is employed, it is preferred that the frame be secured in place via a latch so that vibrations caused by the printing system do not cause the framed heat source to move during a print run. A preferred mechanism for the sliding/rolling movement of the frame is akin to if not identical to a drawer slider assembly that is, for example, installed on the sides of a drawer and is known in the art. Other mechanisms for moving the heat source frame away from the drying system include a slider assembly that is attachable to the underside of the frame, which is also known in the art.

The frame 904 itself can be formed of any suitable material, whether a heat-resistant plastic or a metal, which is provided as a non-limitative example. The frame 904 is of such construction such that elements (not shown) that provide radiant energy are mountable therein, including electrical connections and the like. It is also preferable that the frame 904 include vents (not shown) through which, on one side, air flows from outside the drying system (i.e., intake vents) and, on another side, from the heat source 110 to the web path 102 (i.e., exit vents). A fan or fans can be mounted within the frame of the heat source, or upstream or downstream of that point, so long as the fan is oriented to direct air from outside the drying unit into the heat source and then into the web path. Preferably, at least one fan 112 is mounted in the heat source frame substantially adjacent to intake vents for air flow from outside the drying system.

The frame of each heat source, when in position within the drying unit, is engageable on at least two opposite sides thereof with an outside wall of the air box that includes an intake port. Preferably, such outside wall includes an insulated panel 902. The air box preferably also has a second wall that includes an exhaust port 914. The contact between the frame and the outside wall of the air box serves to reduce the area from which air flowing from the heat source frame escapes the drying system. Additionally, the contact between the frame and the outside wall of the air box is such that a web path is defined there between. The web path at and between the heat source frame and the air box is a drying space for the web. In a preferred embodiment, the apertures that permit fluid communication between the web path and the exhaust conduit are located at or adjacent to the web path 102 and can be coplanar with the insulated panel. Preferably, these apertures are substantially adjacent to the web path of the drying space. Yet more preferably, the web path is framed on either side of the path by these apertures 908*a*, 908*b*. Preferably, a substantial proportion of the air flowing from the heat source frame proceeds through the apertures 908*a*, 908*b* into the air box 308.

The intake vents can be open to the atmosphere of the building in which the printing system is housed. Alternatively, the intake vents can be in fluid communication with an air filtering assembly (not shown) for removal of particles that may be in the ambient air in order to avoid having such particles attach to the print medium by sticking to wet ink or by electrostatic attraction, for example. In addition or in the alternative, the intake vents can be in fluid communication with a port to the atmosphere that is outside of the building that houses the printing system. The conduits that provide the fluid communication between the heat source and the air filter or outside atmosphere can be constructed of any suitable material, as noted above. Moreover, the fluid communication described can be of an open or closed design such that if closed with respect to the building atmosphere then substantially all air flowing into the heat source(s) is derived from outside the building that houses the printing system. Air that flows into the drying system can also be pretreated to remove moisture or to add heat, as appropriate to the source of the air and time of year. A moisture remover can be any desiccating mechanism that can be placed in an air flow line. Adding heat to an air flow can be accommodated by running the air through or adjacent a heat coil of flowing hot water or a resistive wire. Alternatively, the conduit that includes the air requiring additional heat can run adjacent machinery that gives off heat that requires tempering. For example, a modern printing operation may include substantial computer servers that are necessarily housed in a room where temperature must be maintained at a sufficiently low level. The intake conduits may be part of an energy-saving solution for keeping such machines cool.

The elements that afford radiant energy in the heat source can be emitters of infrared, microwave, or other radiation usefully employed for drying ink. The amount of radiant energy used preferably varies depending on atmospheric conditions generally, and, specifically, the heat and moisture content of the intake air coming into the heat source frames. Sensors for measuring temperature and moisture content of the intake air can be placed upstream of the entry point for intake air into the heat source frame. The information derived from the sensors is passed to a controller that assesses the levels and then, if the intake air is cold, for example, heat elements in the air frame are preferably turned on and the radiant energy is also preferably modulated for optimal drying. If the intake air is particularly warm, then the controller may send a signal to the heat source to turn down or turn off the heat element as an unneeded energy cost. Under conditions of dry, hot intake air, the energy levels for both radiant and convective energy sources are preferably set to minimums.

The air box is designed to direct the air flow from the heat source frame so that its included vapors and energy content post-drying are not allowed or minimally allowed to escape into the ambient atmosphere of the building that houses the printing system. The air box is constructed from any substantially non-absorbing, formable material; preferably, plastic, sheet metal, cast metal, or the like. The air box preferably has an insulating panel on the side that faces the heat source. The insulating panel is preferably constructed from any material that retards the rate of heat transference. Another preferred characteristic of the insulating panel is that it includes at least one aperture through which the air blown out of the heat source can enter the air box. More preferably, the plane of the air box that includes the insulation panel includes at least one aperture that is situated outside of the area occupied by the web on the web path, thereby allowing air to flow from the heat source into the air box without substantially disturbing the lateral movement of the web.

In a preferred aspect of the drying technology disclosed herein, the heat is effectively captured for delivery to a heat-requiring process that can be near or remote from the site of the printing system. For example, the insulating panel 306*a*, 306*b* itself can be a heat exchanger whereby it absorbs heat and transfers it to a second material that can hold it until delivered to a second site. Heat included in the exit air flow can also be captured by placing the exit air flow in fluid communication with a second heat exchanger unit (not shown). In a typical heat exchanger unit, the exit air is directed over a first set of coils containing a fluid that can absorb and hold heat. Such a fluid has characteristics similar to those of an alkylene glycol, such as ethylene or propylene glycol, which is used in diluted form as a coolant in automobiles. In this fashion, the heat can be captured and used in the heating of the building, or used to heat intake air, if needed. In the case of using the heat from the exit air flow for warming intake air flow, the intake air can be directed over a second set of coils that are in fluid communication with the first set of coils. Passing the heat containing fluid in the coils is preferably controlled by means of valves in the line and the like.

The intake fan and the exhaust fan can be any device that creates a current of air, such as without limitation an impeller fan, a nugget fan, a biscuit fan, a centrifugal fan, a squirrel-cage fan, etc. The drying system 101 can include one or more intake fans upstream of the heat source frame 110, or one or more intake fans per heat source frame; or one or more intake fans in each of the heat source frame 110 and upstream thereto. The drying system 101 can also include one or more exhaust fans downstream of the air box 308, or one or more exhaust fans in, at, or upon the air box; or one or more intake fans in each of the air box and downstream thereto.

Figure 9:
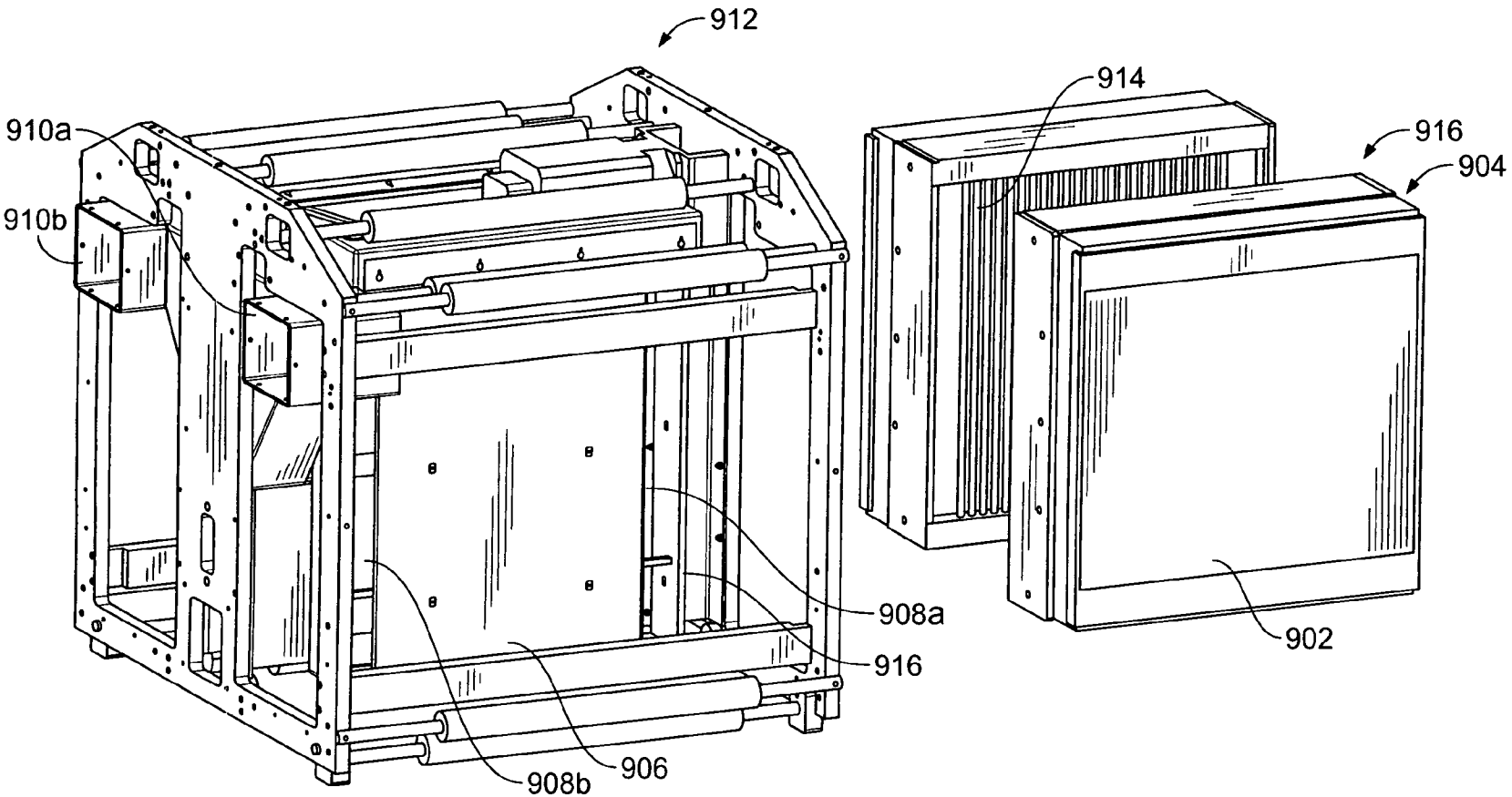
FIG. 9 is an exploded isometric view of another embodiment of the dryer system disclosed herein.

Now referring to FIG. 9, another embodiment of the drying system 912 includes two heat sources in two frames 904*a* and 904*b*. The frames are slideably removeable from the drying system 912. However, when inserted into the drying system 912, the vertical sides of the interior face of the heat source frames come into contact with vertical bars adjacent to exhaust apertures 908*a* and 908*b* to form side seals, as in the previous embodiment. For example, a vertical side 916' of the heat source frame 904*a* comes into contact with a vertical bar 916 to form a first side seal. A second side seal is established at an opposing side of the heat source frame 904*a* through contact of a vertical side 916" with another vertical bar (not visible). The vertical sides 916' and 916" disposed in sealing engagement with the vertical bars lie in a plane offset from a plane defined by the outside wall 906 of the air box, which provides for the web path and the drying space that is created upon sliding in and engaging the heat source frame onto the vertical bars. This embodiment includes two exhaust exits 910*a* and 910*b*, each of which is in fluid communication with the exhaust apertures 908*a* and 908*b*. Another pair of exhaust apertures are included on the other side of the drying system (not visible here).

Figure 11A:
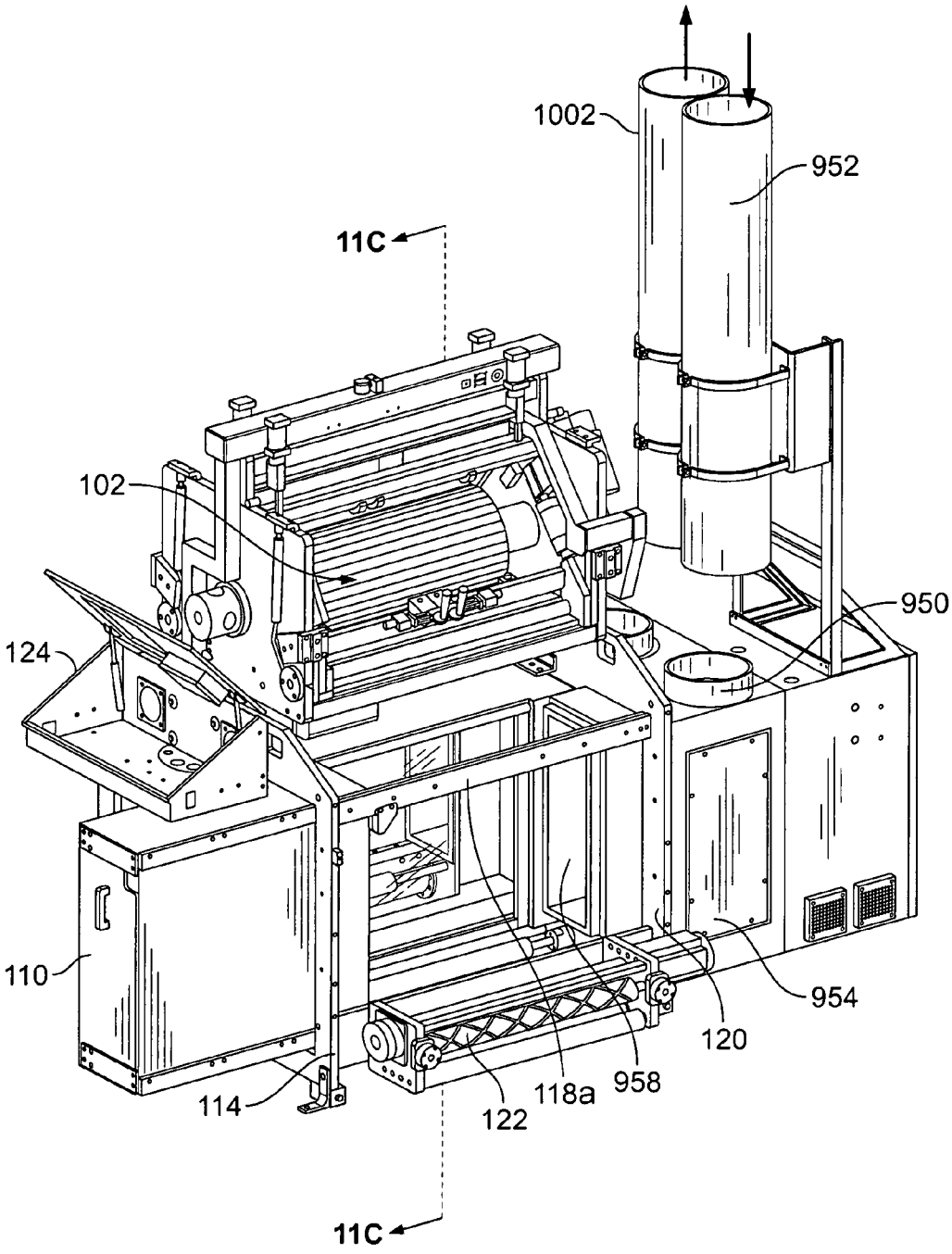
FIGS. 11A and 11B illustrate isometric views of yet an alternative embodiment of the dryer system of FIG. 1, wherein intake air is introduced to the dryer system via a conduit.
Figure 11B:
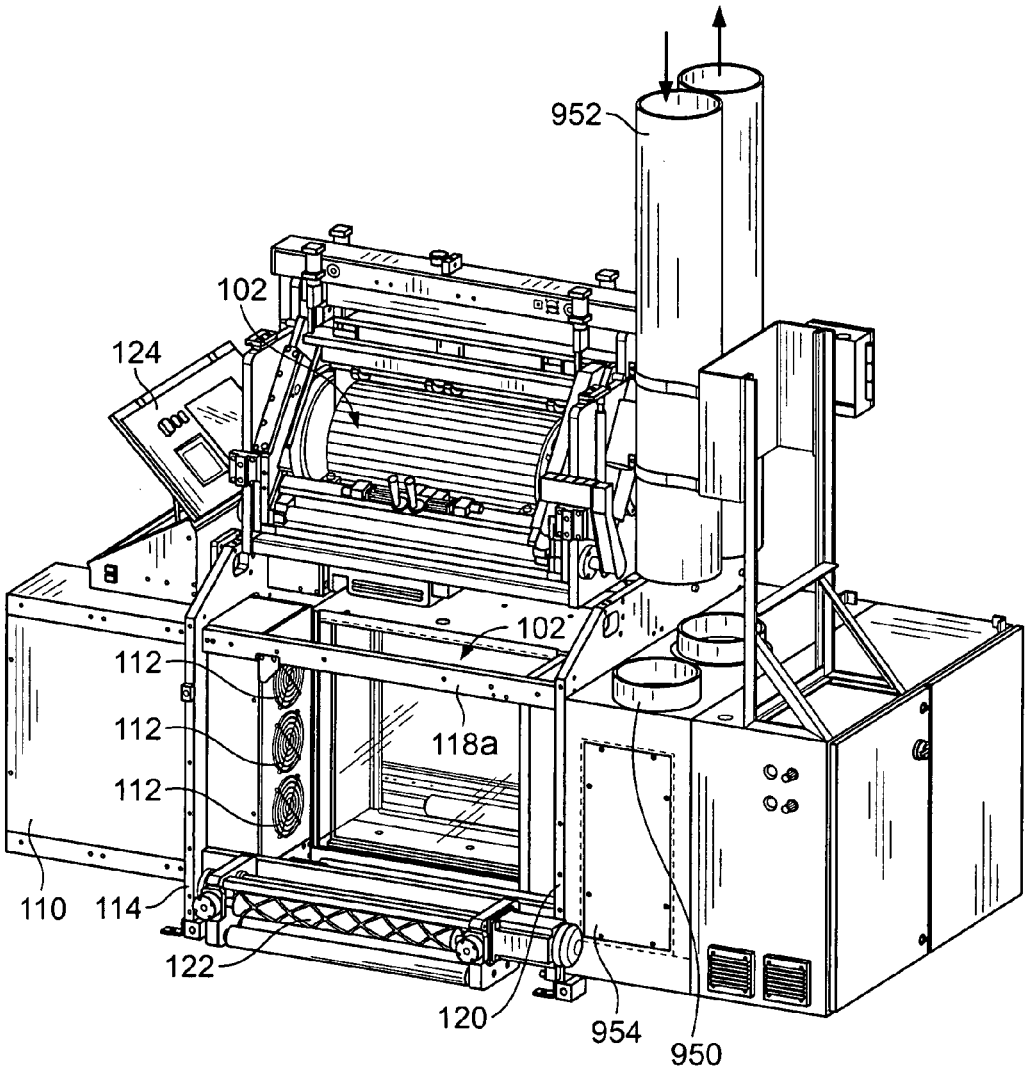
Figure 11C:
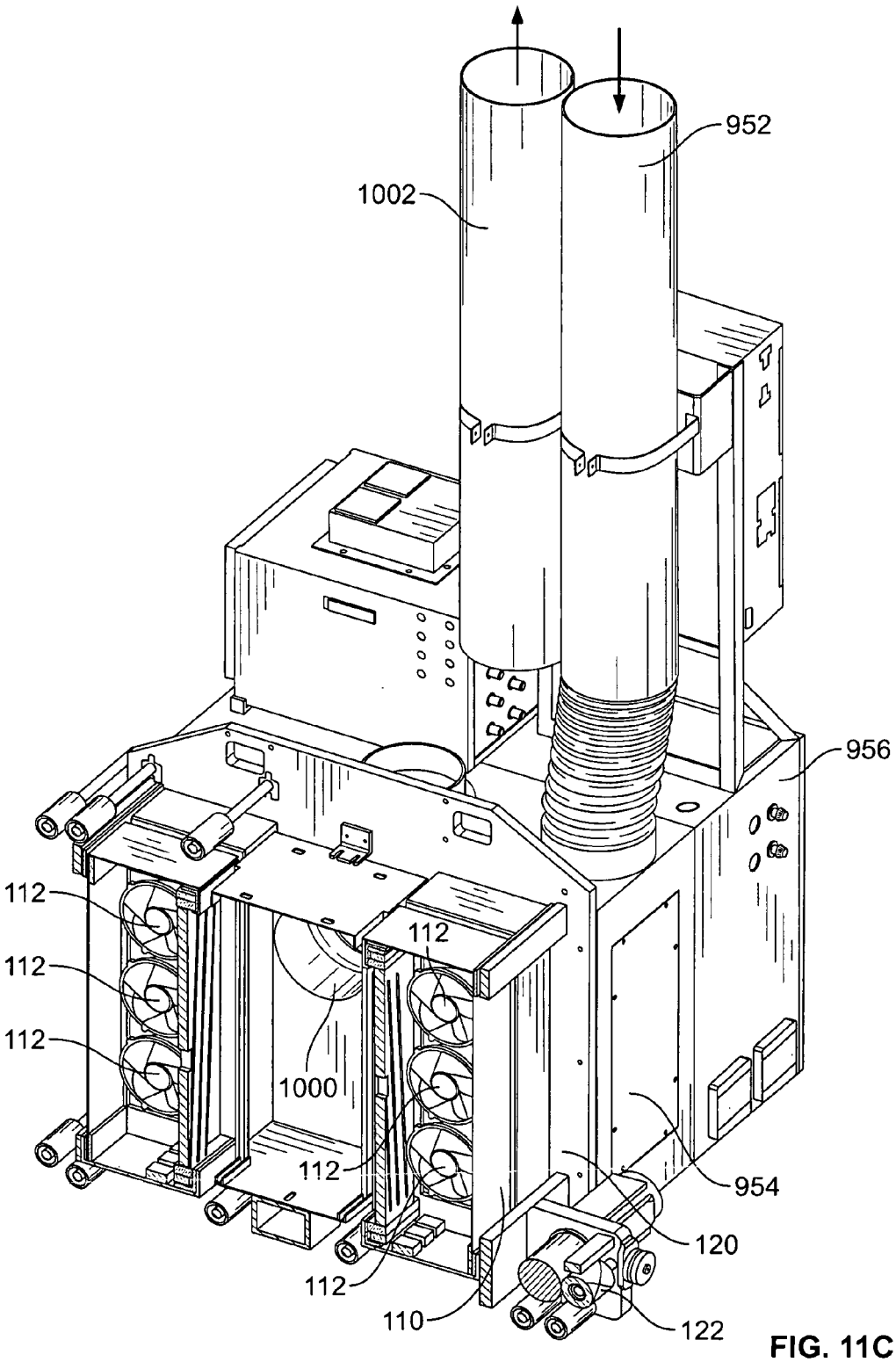
FIG. 11C illustrates a partial sectional view of the dryer system of FIG. 11A taken generally along the lines 11C-11C.

Turning now to FIGS. 11A-11C, another embodiment of the dryer system 101 includes an intake vent 950 that is in fluid communication with a conduit 952. Conduit 952 provides fluid communication between the intake vent 950 and the atmosphere that is exterior of the building that houses the dryer 101. Incoming air from the atmosphere flows through the conduit 952 and the intake vent 950 into an enclosure 954. A flexible tubing 956 is disposed between the conduit 952 and the intake vent 950 (FIG. 11B). The enclosure 954 contains a fluid distribution system (not shown) that channels incoming air toward one or more the heat source(s) 110. The heat source(s) 110 are adapted to removably abut a rectangular opening 958 that is provided on the enclosure 954. Intake fans 112 are provided at a proximal end of the heat source 110 as shown in FIGS. 11B and 11C. When activated via the control panel 124, the intake fans 112 direct the incoming air through the enclosure 954, toward the heat source 110, and further toward the web path 102.

Similar to the air flow disclosed in conjunction with FIG. 5, spent hot air is expelled from the dryer 101 through an exhaust port 1000 that is in fluid communication with an airbox (not shown) disposed adjacent the heat source(s) 110 (FIG. 11C). The exhaust port 1000 channels the spent hot air through an exhaust conduit 1002. As discussed earlier, exhaust conduit 1002 may discharge the spent air to the atmosphere or may be recycled to heat the building housing the dryer 101. In addition, an exhaust fan (not shown) may be adapted to urge air flow through the above described exhaust path.

The foregoing description discloses and describes merely exemplary embodiments and is not intended to be exhaustive or to limit to the precise form disclosed. As will be understood by those skilled in the art, the present disclosure may be embodied in other specific forms, or modified or varied in light of the above teachings, without departing from the spirit thereof.

We claim:

1. A drying unit, comprising:

a base frame;

a plurality of rollers that define a web path within the base frame;

a heat source that is removably attached to the base frame;

an air box mounted within the base frame including an insulating panel disposed adjacent the heat source, an intake port and an exhaust port, wherein a drying space for a continuous web in the web path is defined between the heat source and the air box insulating panel, and wherein a side surface of the heat source is urged into sealing contact with a sealing wall of the insulating panel when the drying unit is operational; and means for movably mounting the heat source relative to the base frame such that the heat source is movable between a first position in the base frame and a second position spaced from the base frame while the continuous web is in the web path.

2. The drying unit of claim 1, wherein the insulating panel includes an aperture through which heated air from the heat source enters the air box.

3. The drying unit of claim 2, wherein the aperture is in heat transfer relationship with the air box.

4. The drying unit of claim 1, wherein the means for movably mounting comprises a ball-bearing based mechanism.

5. The drying unit of claim 1, wherein the means for movably mounting comprises a slider assembly.

6. The drying unit of claim 5, wherein the slider assembly is attached to an underside of a heat source frame that carries the heat source.

* * * * *